US008881639B2

(12) United States Patent
Miller et al.

(10) Patent No.: US 8,881,639 B2
(45) Date of Patent: Nov. 11, 2014

(54) HYBRID BODY ARMOR

(75) Inventors: Daniel Jeffrey Miller, Tampa, FL (US); Autar Krishen Kaw, Tampa, FL (US)

(73) Assignee: University of South Florida (A Florida Non-Profit Corporation), Tampa, FL (US)

( * ) Notice: Subject to any disclaimer, the term of this patent is extended or adjusted under 35 U.S.C. 154(b) by 83 days.

(21) Appl. No.: 13/482,303

(22) Filed: May 29, 2012

(65) Prior Publication Data

US 2012/0297965 A1 Nov. 29, 2012

Related U.S. Application Data

(60) Provisional application No. 61/490,782, filed on May 27, 2011.

(51) Int. Cl.
*F41H 5/04* (2006.01)
*F41H 5/16* (2006.01)

(52) U.S. Cl.
CPC ..... *F41H 5/0471* (2013.01); *F41H 5/0421* (2013.01); *F41H 5/16* (2013.01); *F41H 5/0428* (2013.01); *F41H 5/0457* (2013.01)
USPC ..... 89/36.02; 89/907

(58) Field of Classification Search
CPC ..... F41H 5/02; F41H 5/023; F41H 5/04; F41H 5/16; F41H 1/02; F41H 5/0421
USPC ..... 89/36.02, 906, 907, 908, 909, 910, 912, 89/913, 914, 193
See application file for complete search history.

(56) References Cited

U.S. PATENT DOCUMENTS

| | | | | |
|---|---|---|---|---|
| 4,522,871 | A | 6/1985 | Armellino, Jr. | |
| 5,179,244 | A | 1/1993 | Zufle | |
| 6,792,843 | B2 * | 9/2004 | Mohr et al. | 89/36.02 |
| 6,845,701 | B2 | 1/2005 | Drackett | |
| 7,997,181 | B1 | 8/2011 | Tunis | |
| 8,113,104 | B2 * | 2/2012 | Lucuta et al. | 89/36.02 |
| 2005/0257678 | A1 * | 11/2005 | Camp | 89/36.07 |
| 2005/0262999 | A1 * | 12/2005 | Tomczyk et al. | 89/36.02 |
| 2008/0087161 | A1 * | 4/2008 | Dean et al. | 89/36.05 |
| 2008/0314237 | A1 * | 12/2008 | Cioffi | 89/36.02 |
| 2009/0095147 | A1 * | 4/2009 | Tunis et al. | 89/36.02 |
| 2009/0320676 | A1 * | 12/2009 | Cronin et al. | 89/36.05 |

OTHER PUBLICATIONS

Lopez, C. Todd, "Soldier Testifies to Congress on Body Armor", Army News Services, Feb. 5, 2009.
Lardner, R, "Less Body Armor May be the Answer in Afghanistan", Associated Press, Mar. 10, 1999.
Grau, et al., "Handling the Wounded in a Counter Guerrilla War: the Soviet/Russian Experience in Afghanistan and Chechnya" U.S. Army Medical Department Journal, Jan./Feb. 1998.
Brady, "An Analysis of Would Statistics in Relation to Personal Ballistic Protection" Edinburgh South Australia: DSTO Systems Science Laboratory, 2003.
Olive-Drab LLC. PASGT Body Armor, Fragmentation Protective Vest. May 22, 2008.

(Continued)

*Primary Examiner* — Stephen M Johnson
(74) *Attorney, Agent, or Firm* — Thomas | Horstemeyer, LLP

(57) ABSTRACT

In one embodiment, hybrid body armor includes a ballistic fabric and a plurality of small ballistic plates arranged in a tightly packed array over the ballistic fabric.

12 Claims, 3 Drawing Sheets

(56) References Cited

OTHER PUBLICATIONS

DuPont. Technical Guide, Kevlar Aramid Fibers, Richmond, VA, DuPont, 2010.
U.S. Department of Justice. Ballistic Resistance Body Armor, Standards. Washington DC: U.S. Government, 2008.
Fickler, M.L. "Wounding Patterns of Military Rifle Bullets", International Defense Review, Jan. 1989: 59-64.
Pinnacle Armor. Duty-Uniform Body Armor. 2010; http://www.pinnaclearmor.com/body-armor/duty-uniform; accessed Jan. 17, 2011.
Olive-Drab LLC. Interceptor Body Armor System, May 22, 2008; http://www.olive-drab.com/od_soldiers_gear_body_armor_interceptor.php; (accessed Jan. 17, 2011.
Tabiei, et al., Ballistic Impact of Cry Woven Fabric Composties: A Review: Applied Mechanics Reviews 61 (Jan. 2008).
Hahn, et al. Design, Manufacturing, and Performance of Stitched Stiffened Composite Panels with and Without Impace Damage. Technical, Federal Aviation Administration, Los Angeles: U.S. Dept. of Transportation, 2002.
Mat-Web, AISI Type S1 Tool Steel, quenched 955° C (1750° F) tempered 250° C (500° F), 2 pages.
Mat-Web, CeramTec Rocar® SiG Silicon Carbide, SiSiC, 2 pages.
Chocron, Benloulo and Sánchez- Gálvez, "A New Analytical Model to Simulate Impact onto Ceramic/Composite Armors," International Journal of Impact Engineering, vol. 21, No. 6, 1998, pp. 461-171.
Mat-Web, Coors Tek Boron Carbide Reaction-Bonded Boron Carbide, 1 pages.
Crandall, S.H., L.G. Kurzweil and A.K. Nigam, "On the Measurement of Poisson's Ratio for Modeling Clay," Experimental Mechanics, Sep. 1971, pp. 402-407.
David, N.V., X.L. Gao, and J.Q. Zheng, "Ballistic Resistant Body Armor: Contemporary and Prospective Materials and Related Protection Mechanisms," Applied Mechanics Reviews, Sep. 2009, vol. 62, pp. 050802-1-050802-20.
Fellows, N.A. and P.C. Barton, "Development of Impact Model for Ceramic-Faced Semi-Infinite Armour," International Jounral of Impact Engineering 22 (1999), pp. 793-811.
Gellert, E.P., S.D. Pattie, R.L. Woodward, "Energy Transfer in Ballistic Perforation of Fibre Reinforced Composites," Journal of Materials Science 33 (1998) , pp. 1845-1850.
Journal of Special Operations Medicine, United States Marine Corps Forces, ISSN 1553-9768 Winter 2007, vol. 7, Edition 1.
Li, X., H.L. Cao, S. Gao, F.Y. Pan, L.Q. Weng, S.H. Song and Y.D. Huang, "Preparation of Body Armour Material of Kevlar Fabric Treated with Colloida, Silica Nanocomposite," Institute of Materials, Minerals and Mining, 2008, vol. 37, No. 5/6, pp. 223-226.
Polska, Official Promotional Website of the Republic of Poland, Ministry of Foreign Affairs, Jan Szczepanik: Polish Edison, http://en.poland.gov.pl/Jan,Szczepanik, Polish, Edison, 1986.html (accessed Jan. 17, 2011).
Shokrieh, M.M. and G. H. Javadpour, "Penetration Analysis of a Projectile in Ceramic Composite Armor," ScienceDirect, Composite Structures 82 (2008), pp. 269-276.
Mat-Web, Titanium Ti-4, 5Al—5Mo-1.5Cr (Corona 5), 1 page.
Patrick, Urey W., "Handgun Wounding Factors and Effectiveness," U.S. Department of Justice, Federal Bureau of Investigation, FBI Academy Firearms Training Unit, Jul. 14, 1989, pp. 1-16.
VietnamGear.com, Vietnam War Uniforms & Equipment, 1952AFlak Vest, 1 page.
Wikipedia, Bulletproof vest, 3 pages.
Teng, X., T. Wierzbicki and M. Huang, "Ballistic Resistance of Double-Layered Armor Plates," International Journal of Impact Engineering 35 (2008, pp. 870-884.
Berg, Vanessa S., Jerome H. Stofleth, Dale S. Preece, and Mathew A. Risenmay, "Kevlar and Carbon Composite Body Armor—Analysis and Testing," Proceedings of the ASME Pressure Vessels and Piping Division Conference, 2005, pp. 787-795.
Hannon, F.S. and K.H. Abbott, "Ceramic Armor Stops Bullets, Lowers Weight," Material Engineering, Sep. 1968, pp. 42-43.
Croitoro, Elena M. and I. Eugen Boros, "Flexible Stab Resistant Ceramic-Based Body Armor," Transactions of the Csme 31 (2007), pp. 157-165.
Hodge, N., "US Seeks to Switch Body Armour," Jane's Defense Weekly, Jun. 2006, pp. 623-624.

* cited by examiner

HYBRID BODY ARMOR

CROSS-REFERENCE TO RELATED APPLICATION

This application claims priority to copending U.S. provisional application entitled, "Personal Armor Systems and Methods," having Ser. No. 61/490,782, filed May 27, 2011, which is entirely incorporated herein by reference.

BACKGROUND

Current military-grade body armor technology uses ballistic plates positioned on top of some type of composite or woven textile material to stop projectiles and absorb the energy of the impact. For example, a conventional "bullet proof" vest typically comprises a Kevlar® fabric that includes pockets positioned over the chest and back in which large ceramic plates can be placed to protect the vital organs within the chest cavity (e.g., heart, lungs, etc.). In some cases, the plates are about the size of a standard piece of paper.

Although body armor of the type described above can be useful in protecting the wearer from harm or death, there are various drawbacks of such armor. First, the ceramic plates are heavy and therefore create a lot of weight for the wearer to bear. Second, the large, rigid plates restrict the joint movement of the wearer. Therefore, while the armor provides protection to the wearer, the wearer sacrifices mobility. Third, although the plates are large, they leave much of the wearer's body exposed, including at least part of the sides, stomach, lower back, and neck.

In view of the above discussion, it can be appreciated that it would be desirable to have alternative body armor.

BRIEF DESCRIPTION OF THE DRAWINGS

The present disclosure may be better understood with reference to the following figures. Matching reference numerals designate corresponding parts throughout the figures, which are not necessarily drawn to scale.

DETAILED DESCRIPTION

As described above, it would be desirable to have alternative body armor that avoids one or more of the disadvantages of conventional body armor. Described herein are embodiments of hybrid body armor that provide increased mobility and/or greater protection to the wearer. In some embodiments, the hybrid body armor comprises an array of small ballistic plates that are packed closely together over a ballistic fabric. The hybrid body armor offers the wearer an optimal balance of mobility and protection against many assault-rifle projectiles, such as the 7.62 mm Soviet and 5.56 mm NATO rounds.

In the following disclosure, various embodiments are described. It is to be understood that those embodiments are example implementations of the disclosed inventions and that alternative embodiments are possible. All such embodiments are intended to fall within the scope of this disclosure.

Figure 1:
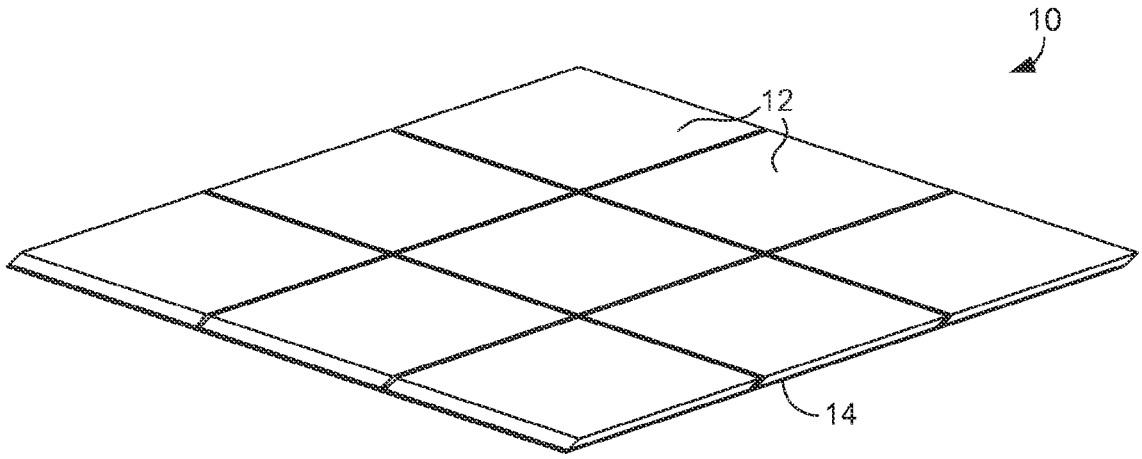
FIG. 1 is a perspective view of an embodiment of hybrid body armor.
Figure 2:
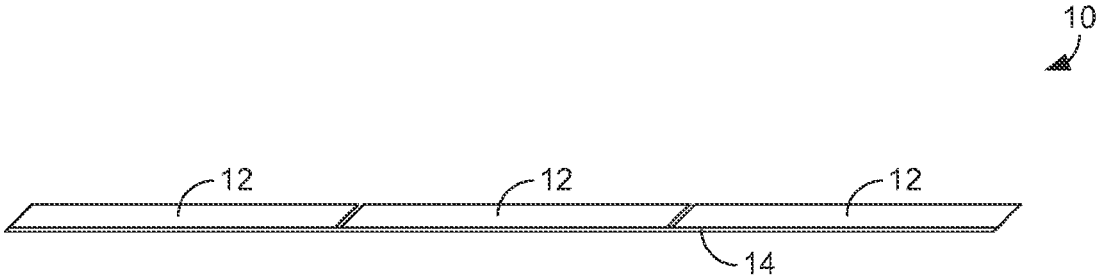
FIG. 2 is a side view of the hybrid body armor of FIG. 1.

FIGS. 1 and 2 illustrate example hybrid body armor 10 that can be used to form a protective garment or other item designed to protect a person or animal from ballistic projectiles. The body armor 10 generally includes a plurality of small ballistic plates 12 that are positioned over a ballistic fabric 14. As is shown in FIG. 1, the plates 12 are arranged in a tightly-packed, two-dimensional array or matrix. In the example of the figure, the matrix comprises a 3×3 matrix of plates 12. Of course, a greater or smaller matrix can be formed. As is apparent from FIGS. 1 and 2, the plates 12 are designed so as to overlap each other along their edges to minimize the potential for a projectile or projectile fragment to pass between adjacent plates. In some embodiments, the ballistic fabric 14 comprises multiple layers of woven aramid material, such as para-aramid (e.g., Kevlar®) or meta-aramid (e.g., Nomex®). In some embodiments, the fabric 14 comprises approximately 14 to 22 layers (e.g., 16 layers) of Kevlar fabric, each plain-woven and having a thickness of approximately 0.4 to 0.7 mm, for example 0.5 mm. In some embodiments, the plain woven Kevlar® fabric can be 1,500 denier fabric, can be comprised of approximately 0.9 to 0.12 mm (e.g., 0.11 mm) diameter fibers, can have a fiber weave pitch of approximately 3.1 to 3.25 mm (e.g., 3.175 mm), and can have approximately 12.25 to 12.75 (e.g., 12.5) threads per inch.

Figure 3:
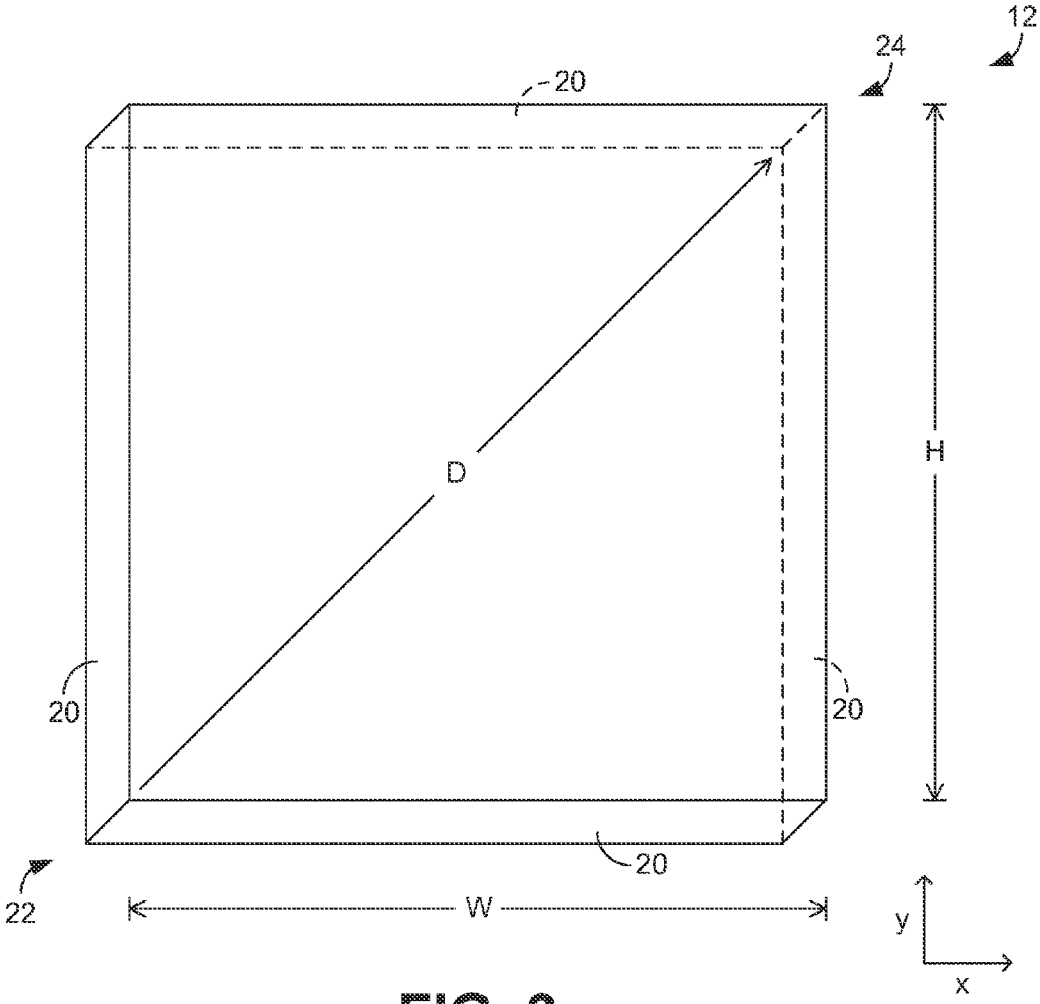
FIG. 3 is a top view of an embodiment of a ballistic plate that can be used in the hybrid body armor of FIG. 1.
Figure 4:
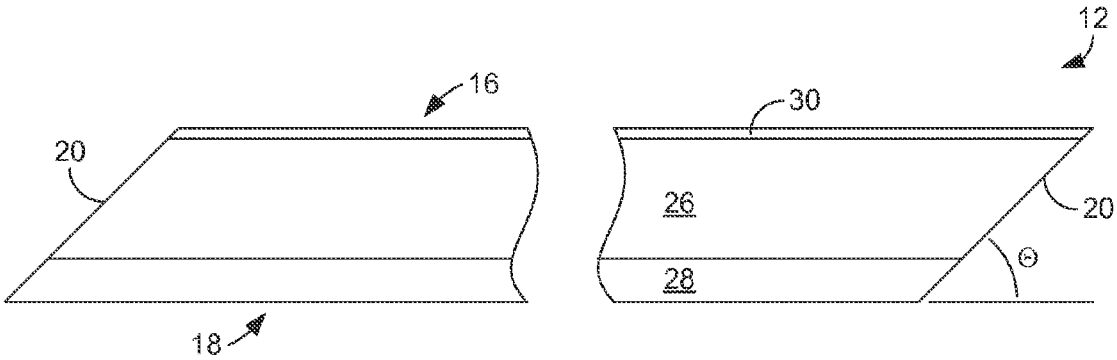
FIG. 4 is a partial side view of the ballistic plate of FIG. 3.

FIGS. 3 and 4 illustrate an example embodiment for a ballistic plate 12. As is shown in those figures, the plate 12 is generally rectangular and is defined by top and bottom sides 16 and 18, and lateral sides 20. In some embodiments, the plate 12 is square and is approximately 70 to 80 mm long in both the height (H) and width (W) directions. In one example embodiment, the plate 12 is approximately 76.3 mm long in the height and width directions. In some embodiments, the plate 12 is approximately 6 to 10 mm thick. In one example embodiment, the plate 12 is approximately 8.8 mm thick.

Figure 5:
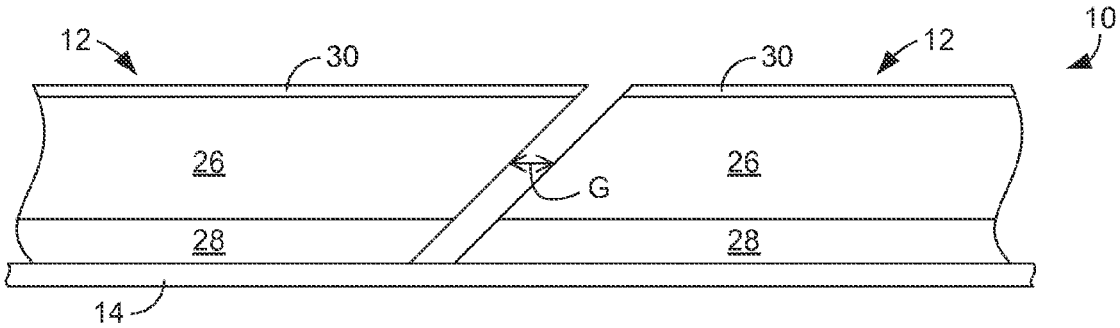
FIG. 5 is a partial side view of two ballistic plates as associated in the hybrid body armor of FIG. 1.

Opposed lateral sides 20 of the plate 12 are parallel to each other, and each lateral side is sloped or angled in both an x direction and a y direction (see FIG. 3). This sloping of the lateral sides 20 results in a shifting of the top side 16 of the plate 12 relative to the bottom side 18 of the plate along a diagonal direction D that extends from a first corner 22 of the plate to a second corner 24 of the plate. With such a configuration, two lateral sides 20 of the plate 12 are adapted to overlap two lateral sides of adjacent plates, specifically one lateral side of each of the two other plates, as is depicted in FIG. 1 and FIG. 5. The slope angle Θ, as measured from a side view normal to the side 20 of the plate 12 (see FIG. 4), can be selected to suit the particular underlying application. In some embodiments, Θis approximately 30° to 85°, such as 45°. As is shown in FIG. 5, the slopes form a diagonal gap G between adjacent plates 12 that can be approximately 0.5 to 4.5 mm wide.

FIG. 4 also illustrates an example construction for the plate 12. As is shown in that figure, the plate 12 can comprise two primary layers, including a ceramic layer 26 and a metal layer 28. In such a case, the ceramic layer 26 degrades (e.g., destroys or mushrooms) and decelerates the projectile, while the metal layer 28 distributes the force of the projectile or projectile fragments. Further distribution of the force is provided by the ballistic fabric 14 described above in relation to FIGS. 1 and 2. In some embodiments, the ceramic layer 26 is made of aluminum oxide ($Al_2O_3$) and the metal layer 28 is made of aluminum (Al). By way of example, those layers can be formed by diffusion (Al to $AL_2O_3$). Alternatively, molten Al can be poured onto formed $Al_2O_3$. In other embodiments, the ceramic layer 26 can be made of boron-carbide ($B_4C$) or silicon-carbide (SiC), and the metal layer 28 can be made of steel or titanium.

As is also shown in FIG. 4, the plate 12 can include a ballistic fabric layer 30 that increases the second (or multiple) hit capacity of the plate 12 and therefore the armor 10. The fabric layer 30 can also be made of an aramid material. In some embodiments, the fabric layer 30 comprises plain woven Kevlar® fabric having a thickness of approximately 0.4 to 0.7 mm, for example 0.5 mm. In some embodiments, the plain woven Kevlar® fabric can be 1,500 denier fabric, can be comprised of approximately 0.9 to 0.12 mm (e.g., 0.11 mm) diameter fibers, can have a fiber weave pitch of approximately 3.1 to 3.25 mm (e.g., 3.175 mm), and can have approximately 12.25 to 12.75 (e.g., 12.5) threads per inch. The fabric layer 30 is affixed to an outer surface of the ceramic layer 26. In some embodiments, the fabric layer 30 is laminated to the ceramic layer 26 using epoxy.

In some embodiments, the ceramic layer 26 is approximately 4 to 7.5 mm thick, the metal layer 28 is approximately 3 to 6 mm thick, and the fabric layer 30 is approximately 0.4 to 0.75 mm thick. In an example embodiment, the ceramic layer 26 is approximately 5 mm thick, the metal layer 28 is approximately 3.3 mm thick, and the fabric layer 30 is approximately 0.5 mm thick, such that the three-layer plate 12 has a thickness of approximately 8.8 mm.

With the above-described construction, the plate 12 is very lightweight. Although the weight of the plate 12 will vary depending upon its length and width dimensions, the plate can have a density of approximately 40 to 47 $kg/m^2$, for example 43.87 $kg/m^2$. In some embodiments, this translates into a weight per plate 12 of approximately 0.2 to 0.4 kg.

Figure 6:
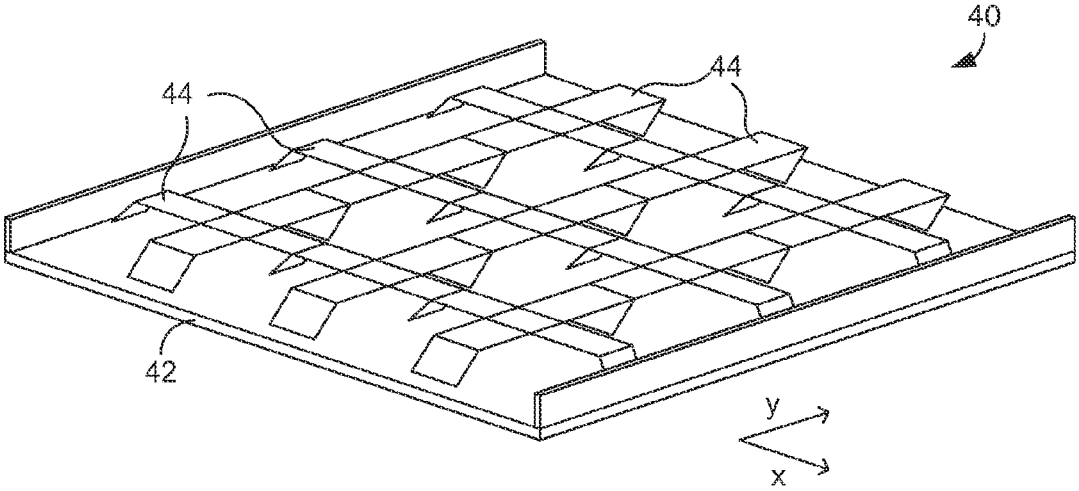
FIG. 6 is a perspective view of an embodiment of an armor carrier that can be used to support ballistic plates.

The plates 12 can be held in place with an armor carrier, such as the carrier 40 shown in FIG. 6. As is illustrated in that figure, the carrier 40 comprises a base 42 that is made of a ballistic fabric such as Kevlar® supports a matrix of retaining straps 44 that extend along both an x direction and a y direction of the carrier to form a cross pattern. Ends of the straps 44 are secured to the base 42 such that plates 12 can be secured to the carrier 40 using with the straps. In some embodiments, the straps 44 are made of a ballistic fabric. In other embodiments, the straps 44 are made of an elastic or inelastic natural or synthetic fabric material. With such a carrier 40, the wearer of the armor 10 has the option to remove or add plates 12 as is necessary or desired.

Figure 7:
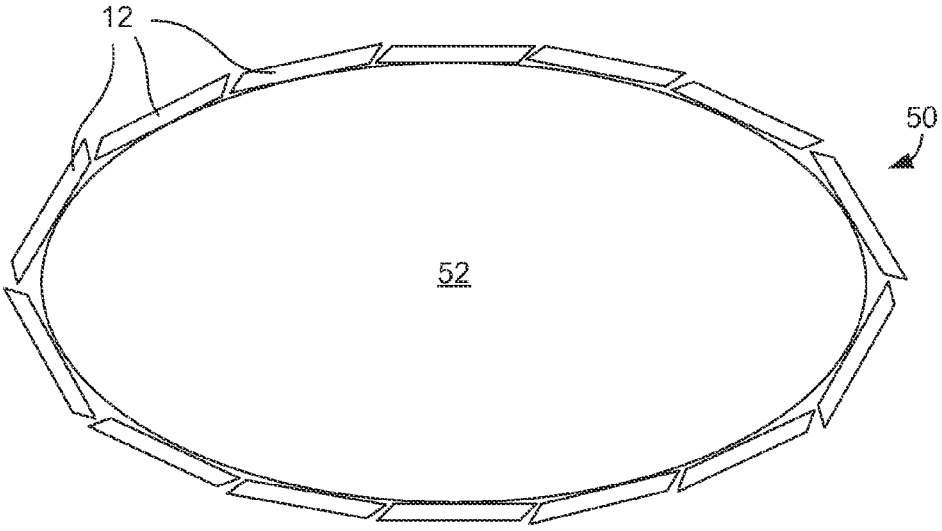
FIG. 7 is a schematic cross-sectional view of a human torso with a body armor garment shown wrapped around the torso.

Because the ballistic plates 12 are relatively small, the armor 10 made from the plates is more flexible. This flexibility is depicted in FIG. 7, which is a schematic representation of a body armor garment 50 wrapped around a human torso 52 shown in cross-section. As is apparent from FIG. 7, the garment 50 is able to follow the curved contours of the torso 52 because the plates 12 are so small. Therefore, while conventional armor typically leaves large areas of the body unprotected, such as the sides, stomach, and lower back, such areas can be protected with armor that utilizes the plate system described herein. The flexibility of the armor also means greater mobility for the wearer. As can further be appreciated from FIG. 7, the manner in which the plates 12 overlap each other (as enabled by their sloped lateral edges), results in substantially continuous coverage of the user's body and minimizes the likelihood of a projectile or projectile fragment reaching the body.

The invention claimed is:

1. A ballistic plate for body armor, the plate comprising:

a metal layer comprising aluminum;

a ceramic layer directly affixed to the metal layer, the ceramic layer comprising aluminum oxide; and a ballistic fabric layer directly laminated to the ceramic layer, the fabric layer comprising multiple layers of woven aramid material;

wherein the plate is generally rectangular and includes a top surface, a bottom surface, and multiple lateral sides that extend between the top and bottom surfaces, each lateral side being sloped so as to form a non-perpendicular angle with the top and bottom surfaces such that the top surface of the plate is diagonally skewed relative to the bottom surface of the plate along a diagonal direction that extends from one corner of the plate to an opposite corner of the plate so that the plate is adapted to overlap two lateral sides of adjacent plates when used in body armor.

2. The ballistic plate of claim 1, wherein the ballistic plate is approximately 70 to 80 millimeters wide and approximately 70 to 80 millimeters tall.

3. The ballistic plate of claim 1, wherein the ballistic plate is approximately 6 to 10 millimeters thick.

4. The ballistic plate of claim 1, wherein the lateral sides are sloped at an angle of approximately 30° to 85°.

5. The ballistic plate of claim 1, wherein the lateral sides are sloped at an angle of approximately 45°.

6. The ballistic plate of claim 1, wherein the plate weighs approximately 0.2 to 0.4 kilograms.

7. Body armor comprising:

a ballistic fabric; and a plurality of small ballistic plates arranged in a tightly-packed array over the ballistic fabric, at least some of the plates comprising:

a metal layer comprising aluminum, a ceramic layer directly affixed to the metal layer, the ceramic layer comprising aluminum oxide, and a ballistic fabric layer directly laminated to the ceramic layer, the fabric layer comprising multiple layers of woven aramid material, wherein the plate is generally rectangular and includes a top surface, a bottom surface, and multiple lateral sides that extend between the top and bottom surfaces, each lateral side being sloped so as to form a non-perpendicular angle with the top and bottom surfaces such that the top surface of the plate is diagonally skewed relative to the bottom surface of the plate along a diagonal direction that extends from one corner of the plate to an opposite corner of the plate so that the plate is adapted to overlap two lateral sides of adjacent plates when used in body armor.

8. The armor of claim 7, wherein the ballistic plate is approximately 70 to 80 millimeters wide and approximately 70 to 80 millimeters tall.

9. The armor of claim 7, wherein the ballistic plate is approximately 6 to 10 millimeters thick.

10. The armor of claim 7, wherein the lateral sides are sloped at an angle of approximately 30° to 85°.

11. The armor of claim 7, wherein the lateral sides are sloped at an angle of approximately 45°.

12. The armor of claim 7, wherein the plate weighs approximately 0.2 to 0.4 kilograms.

* * * * *